US006698856B2

(12) United States Patent
Danzuka

(10) Patent No.: US 6,698,856 B2
(45) Date of Patent: Mar. 2, 2004

(54) PRINTING APPARATUS, PRINTING METHOD, AND COMPUTER-READABLE MEMORY

(75) Inventor: Toshimitsu Danzuka, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/020,297

(22) Filed: Dec. 18, 2001

(65) Prior Publication Data

US 2002/0085052 A1 Jul. 4, 2002

(30) Foreign Application Priority Data

Dec. 19, 2000 (JP) ..... 2000-385934

(51) Int. Cl.[7] ..... B41J 2/21
(52) U.S. Cl. ..... 347/9; 347/15; 347/43
(58) Field of Search ..... 347/43, 15, 9, 347/14, 16, 37

(56) References Cited

U.S. PATENT DOCUMENTS 5,084,758 A 1/1992 Danzuka et al.
5,736,996 A 4/1998 Takada et al.
6,471,322 B2 * 10/2002 Kanda et al. ..... 347/15

FOREIGN PATENT DOCUMENTS

EP 0 633 139 1/1995
EP 0 917 095 5/1999
EP 0 941 858 9/1999

* cited by examiner

*Primary Examiner*—Lamson Nguyen
(74) *Attorney, Agent, or Firm*—Fitzpatrick, Cella, Harper & Scinto

(57) ABSTRACT

The number of printing elements that perform printing with a plurality of types of printing agents is determined in accordance with a maximum multiple printing count with which dots of each one of the plurality of types of printing agents are printed in an overlaying manner at substantially one position on a printing medium.

20 Claims, 14 Drawing Sheets

PRINTING APPARATUS, PRINTING METHOD, AND COMPUTER-READABLE MEMORY

FIELD OF THE INVENTION

The present invention relates to a printing apparatus, printing method, and computer-readable memory for printing with a plurality of types of printing agents on a printing medium by using a printing element.

The present invention also relates to a printing apparatus, printing method, and computer-readable memory for printing with a plurality of types of printing agents on a printing medium by using a printhead with one or a plurality of printing elements.

BACKGROUND OF THE INVENTION

Printing apparatuses such as an ink-jet printer have conventionally been studied and developed widely and are popular. A larger number of gray levels, a higher speed, and a lower price have been sought for in the printing apparatus.

Among these demands, a larger number of gray levels can be effectively met by using a low-concentration printing agent. When a low-concentration printing agent is used, to obtain a desired image density, a large number of dots must be printed with a low-concentration printing agent at substantially one position on a printing medium in an overlaying manner, or so-called multiple printing must be performed, and a problem such as an ink overflow may undesirably occur in, e.g., an ink-jet printer.

In particular, in an ink-jet printer for printing a full-color image by using cyan, magenta, yellow, and black inks, it is difficult to decrease the concentrations of all inks due to the reason described above.

When a yellow ink or a black ink is represented by a color ink of, e.g., yellow, that cannot be visually recognized easily, or a color ink such as black that can be obtained by mixing inks of any other colors (cyan, magenta and yellow), the yellow ink or the black ink is obtained by a dark ink without using any light ink.

Then, the maximum numbers of ink dots of the same color overlaid at substantially one position on the printing medium (to be referred to as maximum multiple printing counts hereinafter) inevitably differ depending on the ink colors (types).

However, in printing using a plurality of types of printing agents with different maximum multiple printing counts, if the number of printing elements for each of the plural printing agent types are the same, the following inconveniences are bound to occur.

For example, when the number suitable for one printing element with a small maximum multiple printing count equal to the number of other printing elements, in printing using a printing agent with a large maximum multiple printing count, the printing speed decreases because the number of printing elements is short.

Alternatively, when the number suitable for one printing element with a large maximum multiple printing count equal to the number of other printing elements, in printing using a printing agent with a small maximum multiple printing count, one or more printing elements are not used at all or not used for a long period of time, leading to waste, i.e., an increase in cost.

In any case, in printing using a plurality of types of printing agents with different maximum multiple printing counts, if the number of each of the printing elements for each of the plural types of printing agents are the same, the above inconveniences are bound to occur.

SUMMARY OF THE INVENTION

The present invention has been made in view of the above problems, and has as its object to provide a printing apparatus, printing method, and computer-readable memory that can prevent both "a decrease of the printing speed caused because the number of printing elements is short" and "an increase in cost caused because one or more printing elements are not used at all or for a long period of time".

According to the present invention, the foregoing object is attained by providing, a printing apparatus for performing printing with a plurality of types of printing agents on a printing medium by using a printing element, comprising:

printing elements, for performing printing with the printing agents, in a number in accordance with a maximum multiple printing count with which dots of each one of the plurality of types of printing agents are printed in an overlaying manner at substantially one position on the printing medium.

Other features and advantages of the present invention will be apparent from the following description taken in conjunction with the accompanying drawings, in which like reference characters designate the same or similar parts throughout the figures thereof.

DETAILED DESCRIPTION OF THE PREFERRED EMBODIMENTS

The preferred embodiments of the present invention will be described in detail with reference to the accompanying drawings.

First Embodiment

Figure 1A:
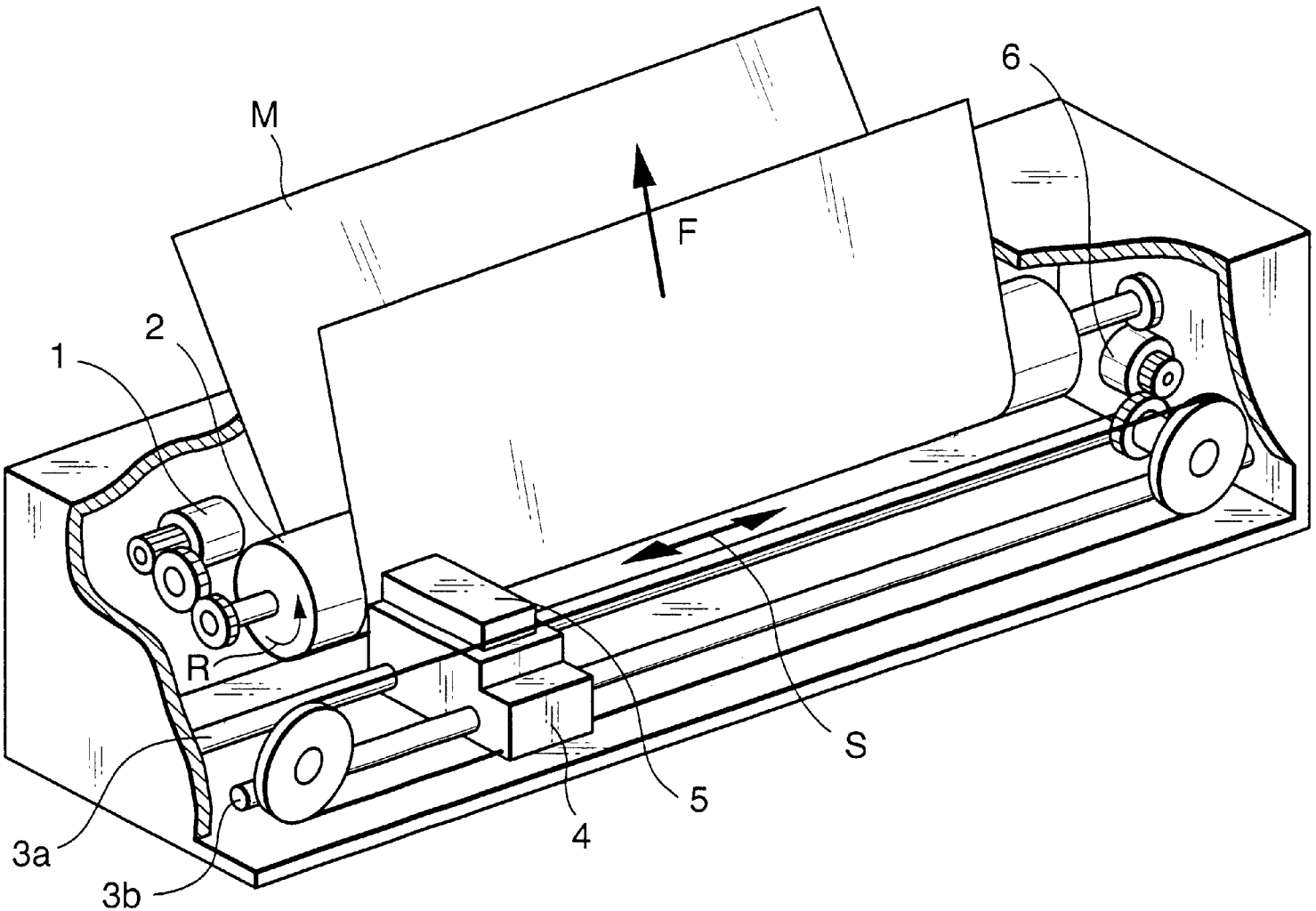
FIG. 1A is a perspective view schematically showing an ink-jet printer according to the first embodiment.

FIG. 1A is a perspective view schematically showing an ink-jet printer according to the first embodiment.

Referring to FIG. 1A, a printing medium (to be referred to as a medium hereinafter) M is fed in the direction of an arrow F in FIG. 1A by a platen roller 2, rotated in the direction of an arrow R in FIG. 1A by the driving operation of a subscanning motor 1, and a convey roller group (not shown).

Guide shafts 3*a* and 3*b* extend parallel to each other in a direction perpendicular to the medium convey direction (subscanning direction). An ink-jet head 5 mounted on a carriage 4 is driven by a main scanning motor 6 to be reciprocally scanned in the directions of an arrow S (main scanning direction) in FIG. 1A.

The medium M is intermittently fed by the subscanning motor 1. When the medium M is stopped, the ink-jet head 5 is reciprocally scanned in the main scanning direction. While being scanned in the main scanning direction, the ink-jet head 5 discharges ink droplets in accordance with an image signal, thereby printing an image. The image signal is supplied from an external unit (not shown), e.g., a host computer, connected to the ink-jet printer.

Figure 1B:
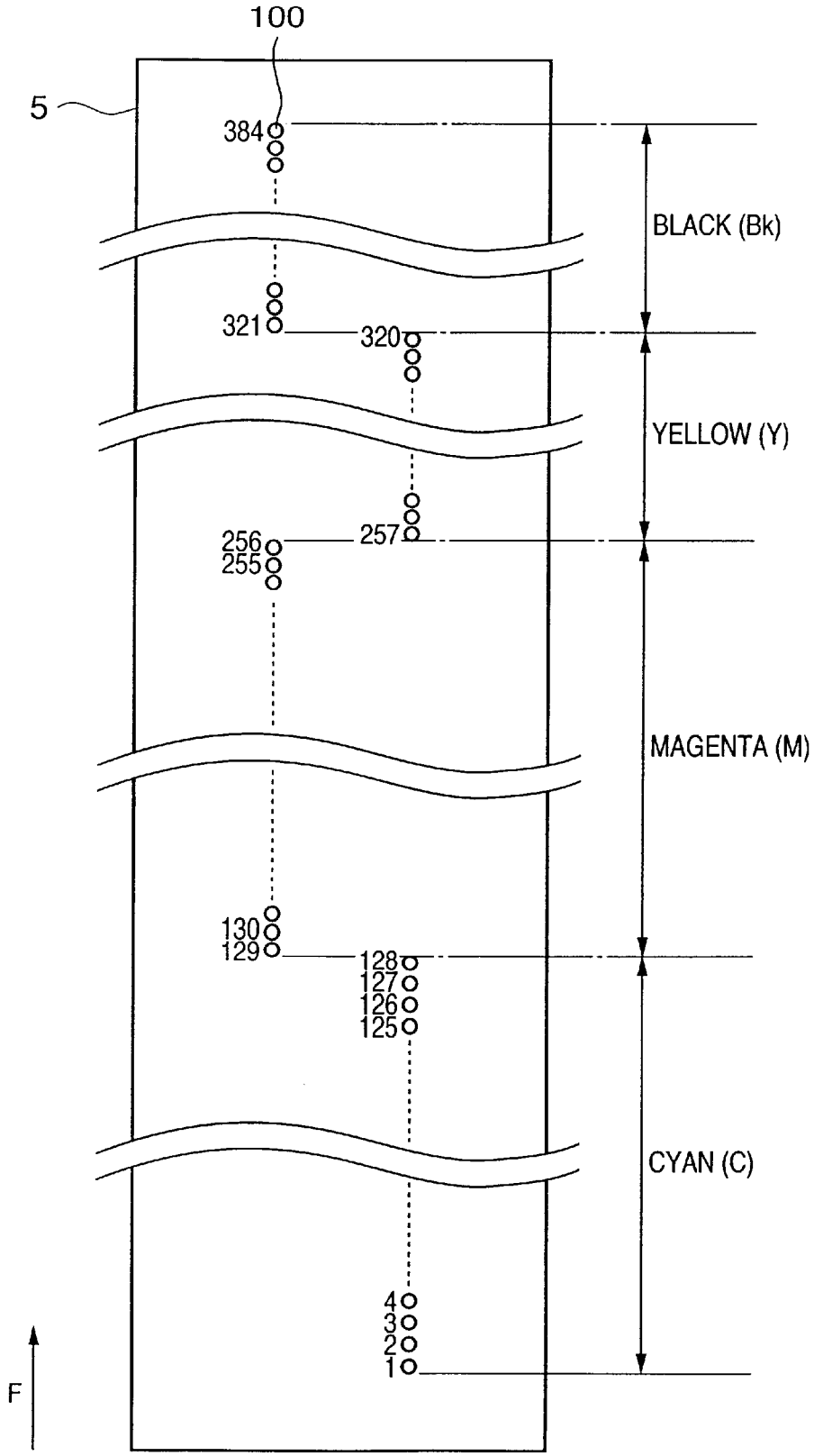
FIG. 1B shows an arrangement of nozzles of an ink-jet head according to the first embodiment.

The ink-jet head 5, as shown in FIG. 1B, has 384 nozzles 100 comprising printing elements, which are arrayed such that their interval in the subscanning direction corresponds to 600 dpi. From the start point of the arrow F in FIG. 1A, sequentially, 128 nozzles discharge cyan ink, 128 nozzles discharge magenta ink, 64 nozzles discharge yellow ink, and 64 nozzles discharge black ink.

Note that inside each nozzle is a heating element for discharging ink.

The ink-jet printer according to the first embodiment has a resolution of 600 dpi (main scanning direction)×600 dpi (subscanning direction). The diameter of a dot formed by an ink droplet of each color ink changes in accordance with the type of medium, and is about 65 $\mu$m on a gloss film in the first embodiment.

The cyan and magenta inks used in the ink-jet printer according to the first embodiment are inks the dye concentrations of which are decreased in order to improve the gray level. The respective dye concentrations are adjusted such that, when two dots are printed in the overlaying manner for each of all 600 dpi×600 dpi pixels on the gloss film, the optical reflection density becomes about 1.7.

Regarding yellow and black inks, the respective dye concentrations are adjusted such that, when one dot is printed for each of all 600 dpi×600 dpi pixels on the gloss film, the optical reflection density becomes about 1.7.

Figure 1C:
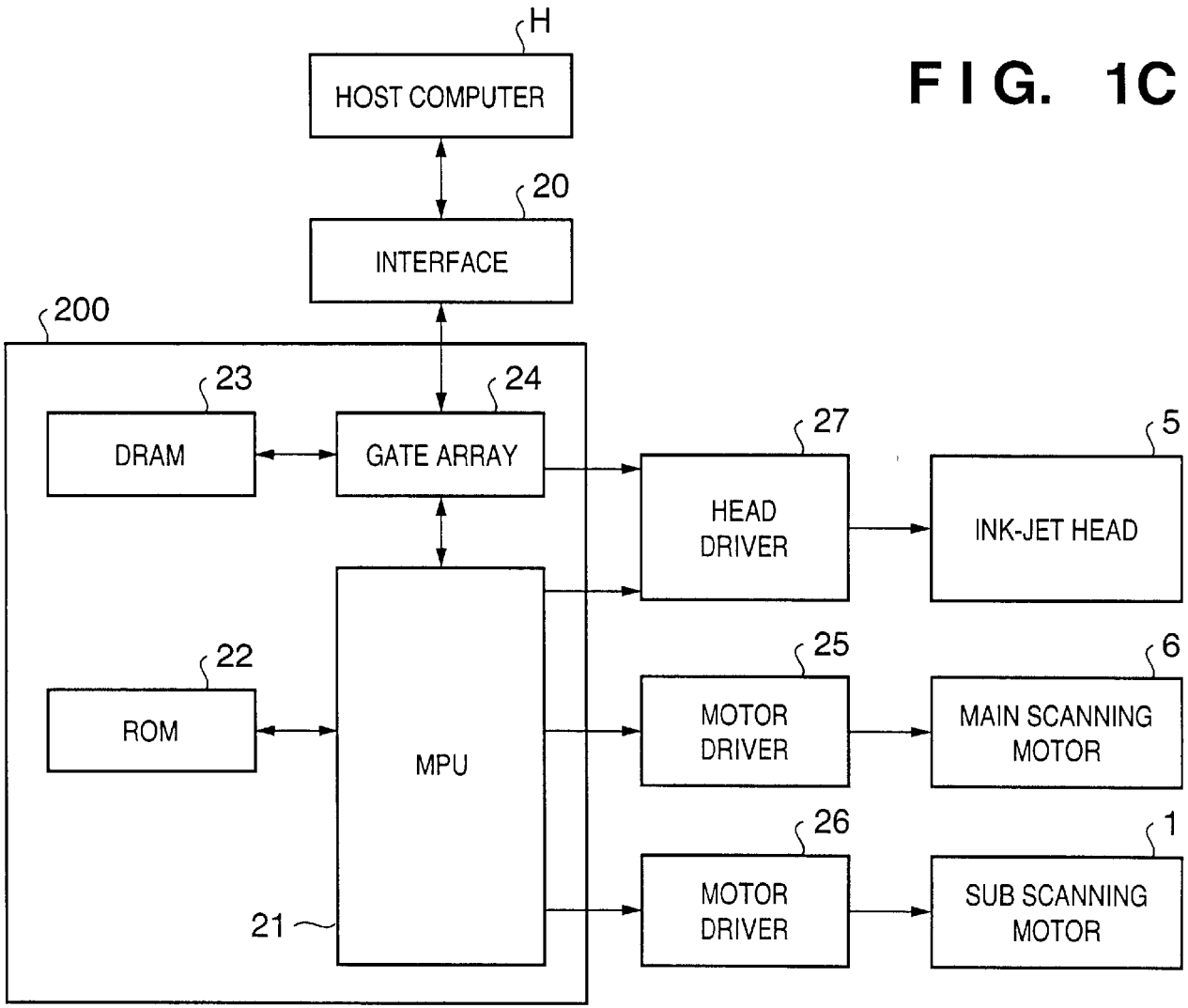
FIG. 1C is a block diagram illustrating the circuit construction including a controller of an ink-jet printer according to the first embodiment.

Therefore, the ink-jet printer according to the first embodiment is controlled by a controller 200 as shown in FIG. 1C such that the cyan and magenta inks are printed with a maximum multiple printing count of 2 while yellow and black inks are printed with a maximum multiple printing count of 1.

Referring to FIG. 1C, reference numeral 20 denotes an interface for exchanging data such as an image signal with a host computer H. Reference numeral 21 denotes an MPU for executing various control procedures. Reference numeral 22 denotes a ROM storing programs corresponding to the control procedures executed by the MPU 21 and any other permanent data. Reference numeral 23 denotes a DRAM for temporarily storing various data (printing data and the like to be supplied to the ink-jet head 5).

Reference numeral 24 denotes a gate array for controlling supply of printing data to the ink-jet head 5. The gate array 24 also controls transfer of data between the interface 20, MPU 21, and DRAM 23. Reference numerals 25 and 26 denote motor drivers for driving the main scanning motor 6 and sub scanning motor 1, respectively. Reference numeral 27 denotes a head driver for driving the ink-jet head 5.

An image printing sequence of the ink-jet printer according to the first embodiment will be briefly described with reference to FIG. 1A and FIGS. 2A to 2F.

Referring to FIG. 1A, when the medium M is conveyed to a predetermined image printing start position by rotation of the platen roller 2 or the like and is stopped, the carriage 4 performs forward scanning, of the forward and backward reciprocal scanning, in the direction of an arrow S in FIG. 1A. In this case, cyan dots are printed in a region indicated by reference symbol A in FIG. 2A by using the 64 nozzles, which are on the start point side (to be referred to as the lower side hereinafter) of the arrow F in FIG. 1B, of the ink-jet head 5 in accordance with the image signal.

Figure 2A:
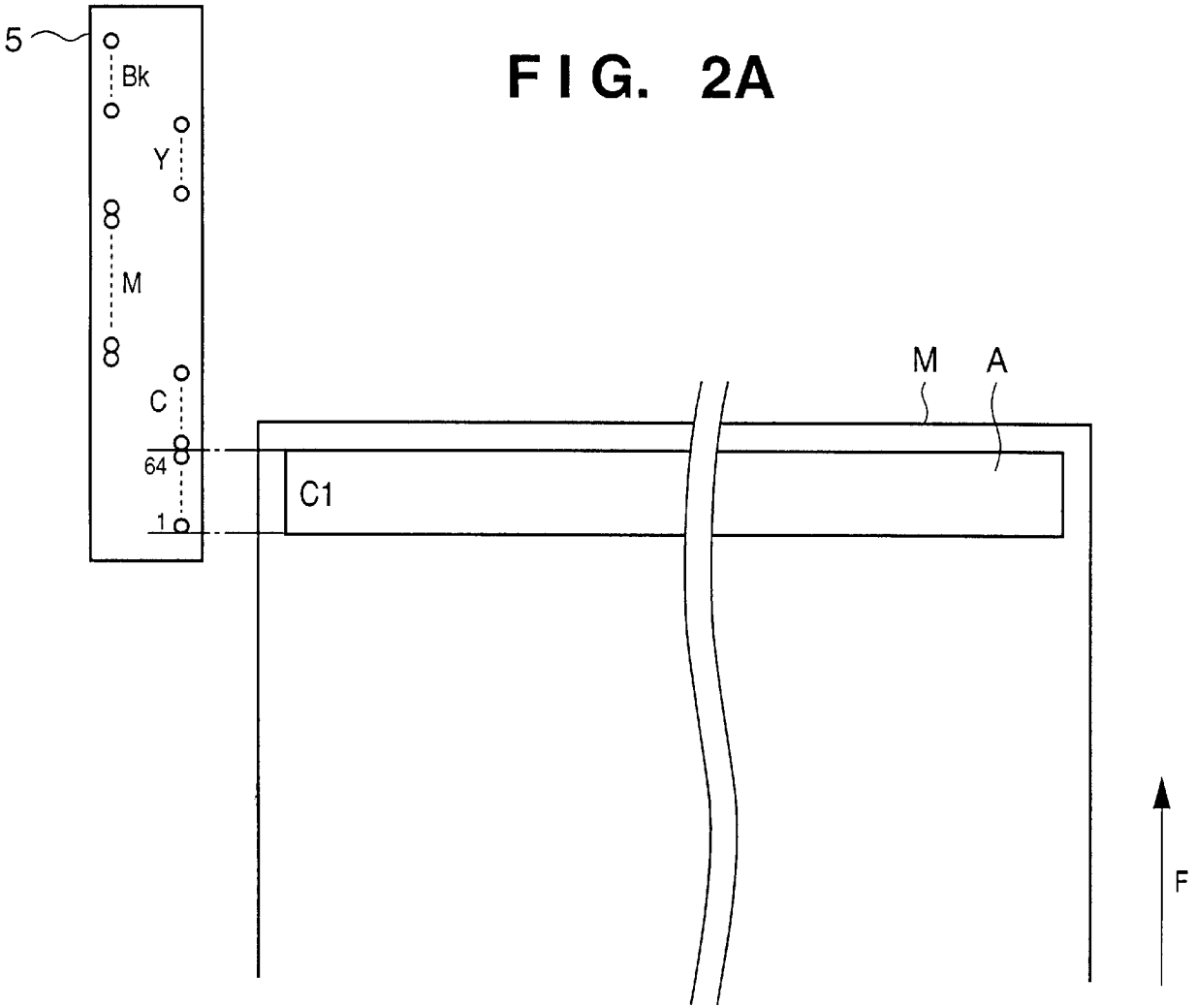
FIGS. 2A to 2F are views for explaining an image printing sequence in the ink-jet printer according to the first embodiment.

Subsequently, the medium M is conveyed (subscanned) for a distance corresponding to the width of the region A shown in FIG. 2A (more specifically, 64/600 inch≈2.71 mm) driven by the sub scanning motor 1.

After that, of the forward and backward reciprocal scanning of the carriage 4, backward scanning is performed. In this case, cyan dots are printed additionally by using the lower 128 nozzles of the ink-jet head 5 in accordance with the image signal, so a cyan image is formed in the region shown in FIG. 2B.

Figure 2B:
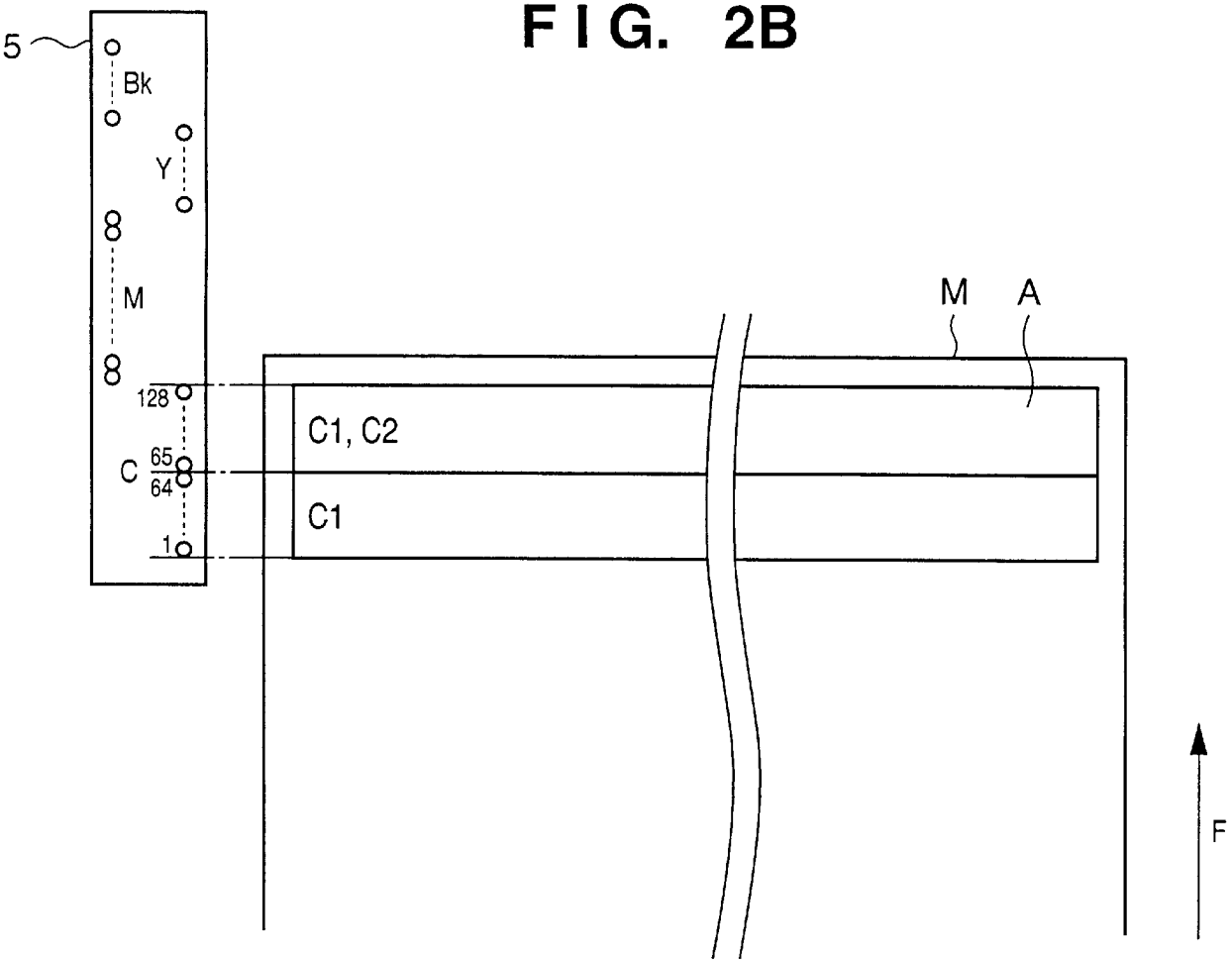

At this time, in the portion indicated by A on the medium M in FIG. 2B, two cyan ink dots can be printed in the overlaying manner for one pixel.

Figure 2C:
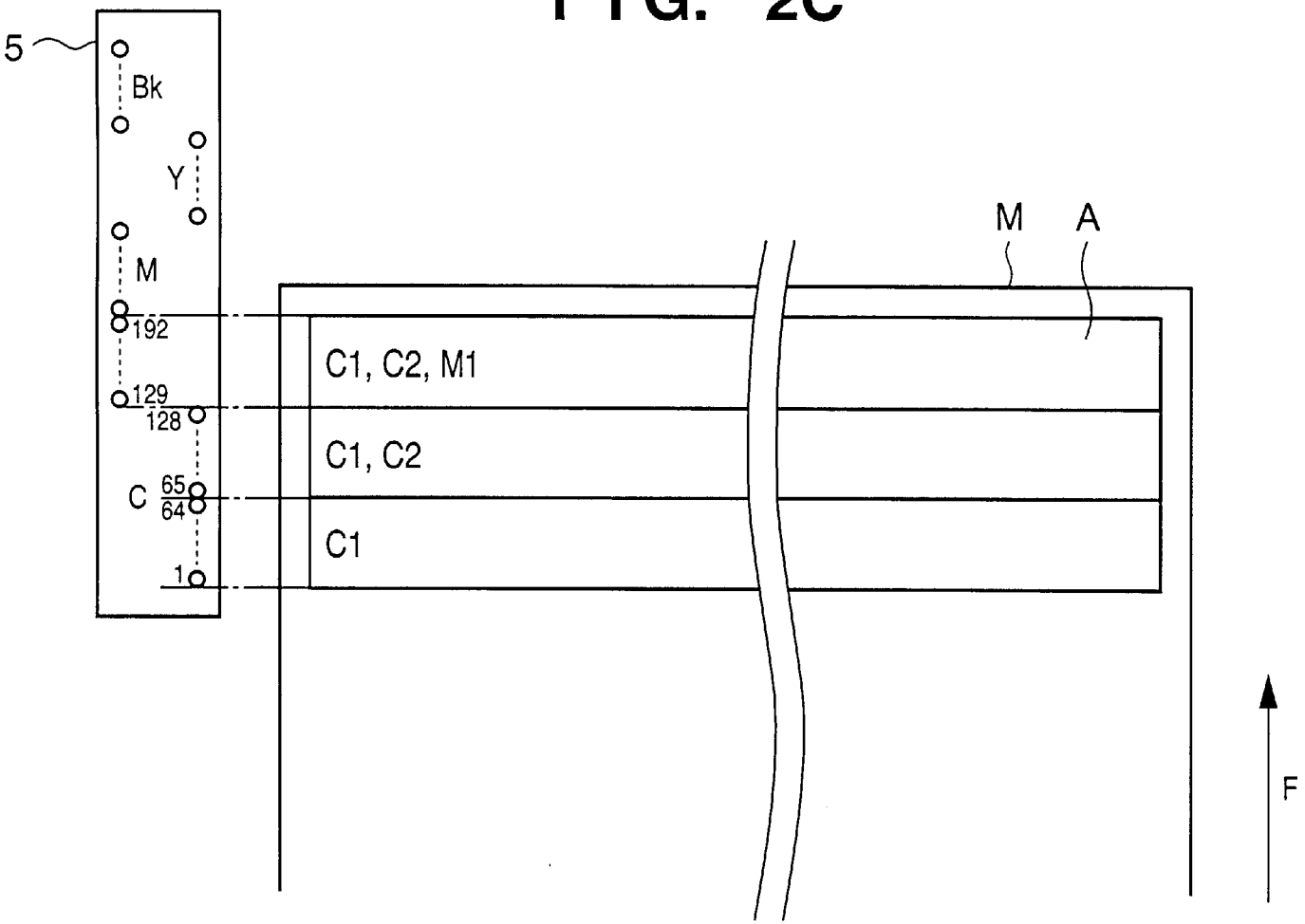

After that, the medium M is subscanned by 2.71 mm. When the carriage 4 is to be scanned forward again, cyan and magenta dots are printed additionally by using the lower 192 nozzles of the ink-jet head 5 in accordance with the image signal, so an image in the region shown in FIG. 2C is formed.

Then, the medium M is further subscanned by 2.71 mm. When the carriage 4 is to be scanned backward again, cyan and magenta dots are printed additionally by using the lower 256 nozzles of the ink-jet head 5 in accordance with the image signal, so an image in the region shown in FIG. 2D is formed.

Figure 2D:
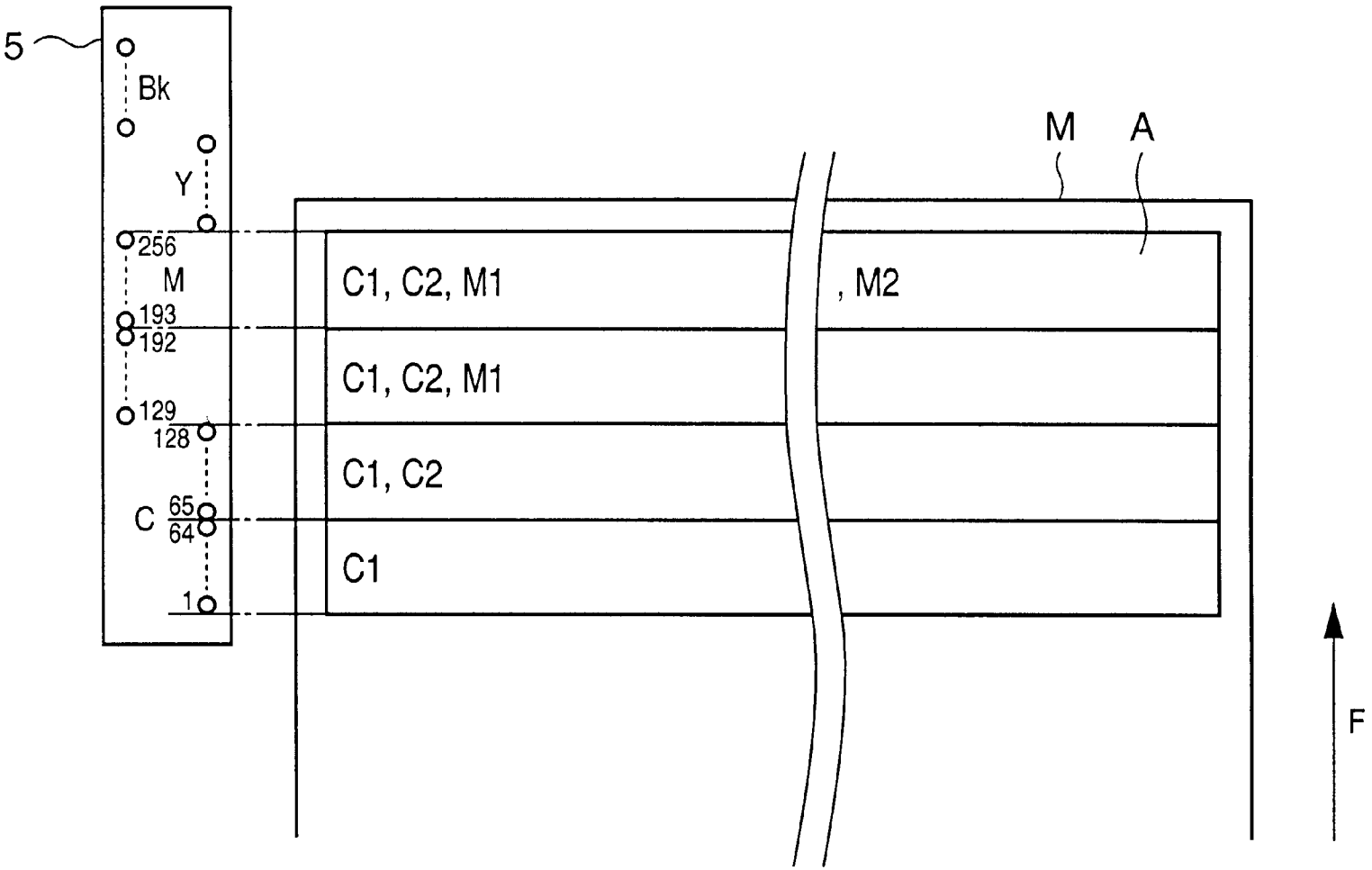

At this time, in the portion indicated by A on the medium M in FIG. 2D, two cyan ink dots and two magenta ink dots can be printed in the overlaying manner for one pixel.

Figure 2E:
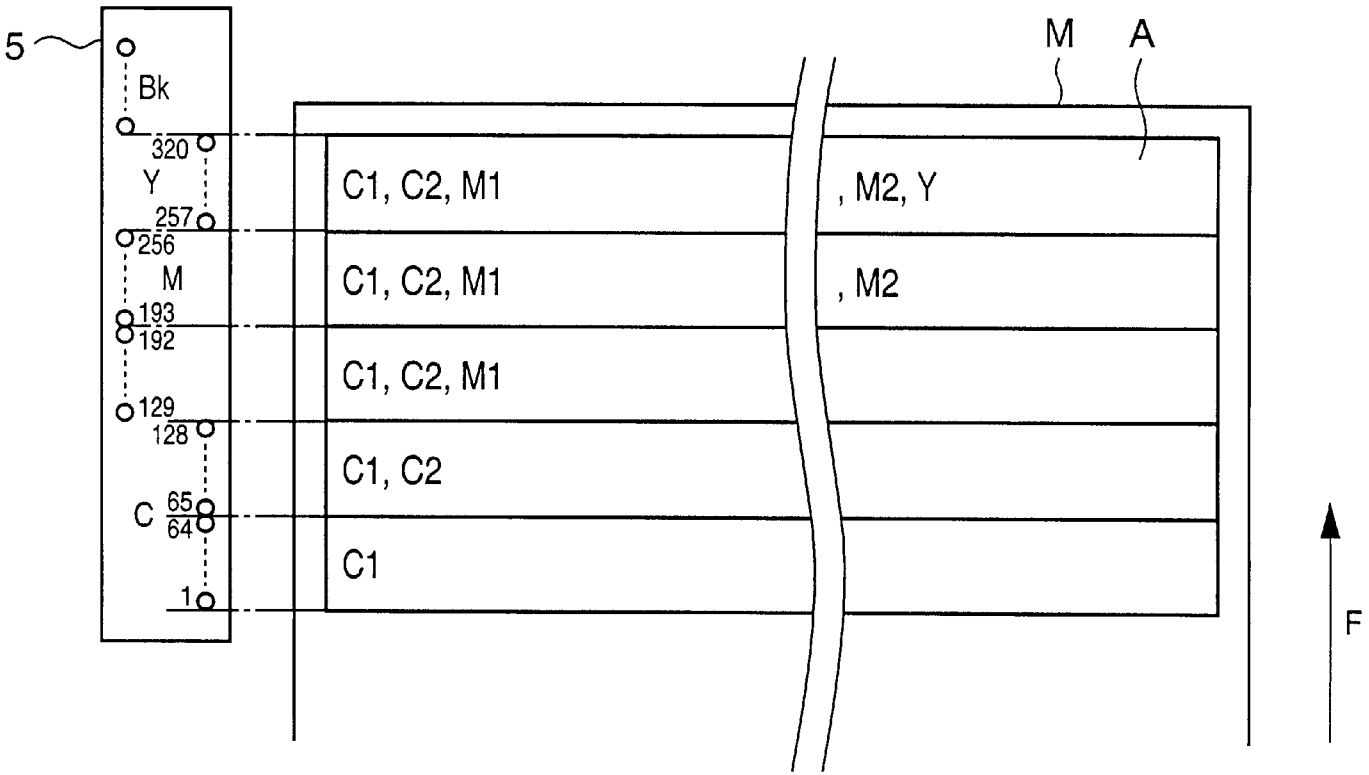

The medium M is then subscanned similarly. When the carriage 4 is to be scanned forward over again, cyan, magenta, and yellow dots are additionally printed by using all the lower 320 nozzles of the ink-jet head 5 in accordance with the image signal, so an image in the region shown in FIG. 2E is formed.

After that, subscanning is performed in the same manner. When the carriage 4 is to be scanned backward over again, cyan, magenta, yellow, and black dots are printed additionally by using all the 384 nozzles of the ink-jet head 5 in accordance with the image signal, so an image in the region shown in FIG. 2F is formed.

Figure 2F:
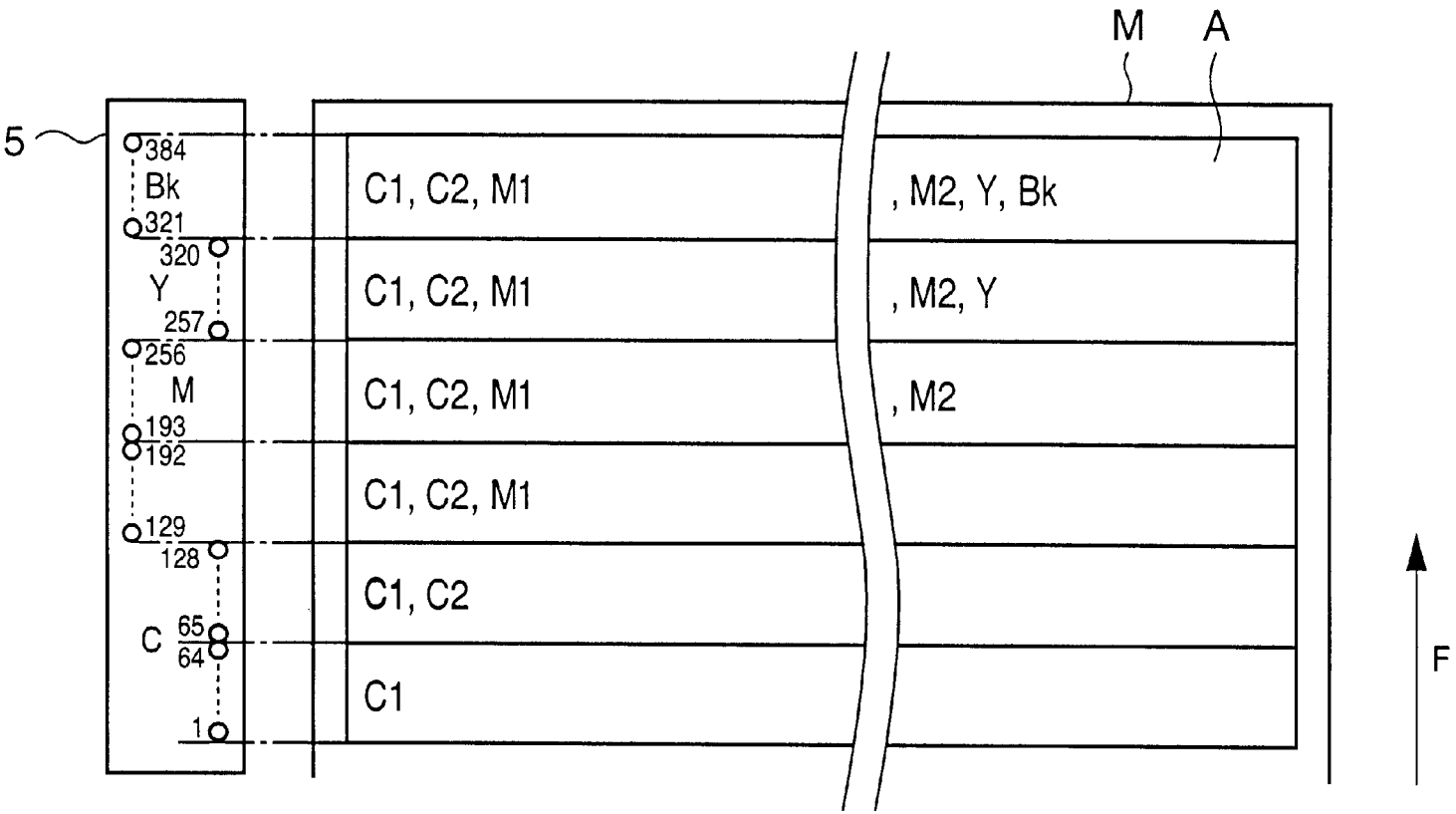

In this manner, in that portion on the medium M which is indicated by A in FIG. 2F, to form one pixel, two cyan ink dots and two magenta ink dots can be printed in the overlaying manner while one yellow ink dot and one black ink dot can be printed.

This operation is repeated until reaching the image printing end position of the medium M, and image printing is ended. The medium M is then delivered by rotation of the platen roller 2 or the like.

As described above, according to the first embodiment, when the number of nozzles that perform printing with cyan and magenta inks, the dye concentrations of which are decreased in order to improve the gray level and with which the maximum multiple printing count is 2, is set to 128, when the number of nozzles that perform printing with yellow and black inks, with which the maximum multiple printing count is 1 by considering an ink overflow or the like, is set to 64, and when the image printing sequence is performed in the above manner, that is, when the control and configuration are implemented such that the maximum multiple printing count ratio of the printing agents is equal to the ratio of the numbers of printing elements for performing printing with the respective printing agents, then image printing can be performed most efficiently. As a result, a decrease in printing speed due to the shortage of nozzles, and an increase in cost which occurs when some nozzle is not used at all or for a long period of time, can both be prevented.

In other words, to describe this in a general way, the printhead according to the present invention has printing elements, for performing printing with a plurality of types of printing agents, in a number which is determined in accordance with the maximum multiple printing count with which the dots of each one of the plurality of types of printing agents are printed in the overlaying manner at substantially one position on the printing medium. Thus, a decrease in printing speed due to the shortage of nozzles, and an increase in cost which occurs when some nozzle is not used at all or for a long period of time, can both be prevented.

The first embodiment exemplifies an ink-jet printer with a resolution of 600 dpi (main scanning direction)×600 dpi (subscanning direction). In an ink-jet printer in which the ink discharging timing of an ink-jet head 5 is controlled for each scanning operation of a carriage 4 and the position of an ink dot with a diameter of about 65 $\mu$m , which is printed on a gloss film, is shifted so the resolution becomes 1,200 dpi (main scanning direction)×600 dpi (subscanning direction), dots that are printed once to form two pixels adjacent in the main scanning direction are overlaid on each other sufficiently. Hence, the present invention is effective for this case as well.

Second Embodiment

The first embodiment exemplifies a case wherein the present invention is applied to an ink-jet printer that prints a full-color image by using four color inks. The second embodiment exemplifies a case wherein the present invention is applied to an ink-jet printer that prints a high-gray level medical image by using three different black-based inks with different dye concentrations.

Figure 3:
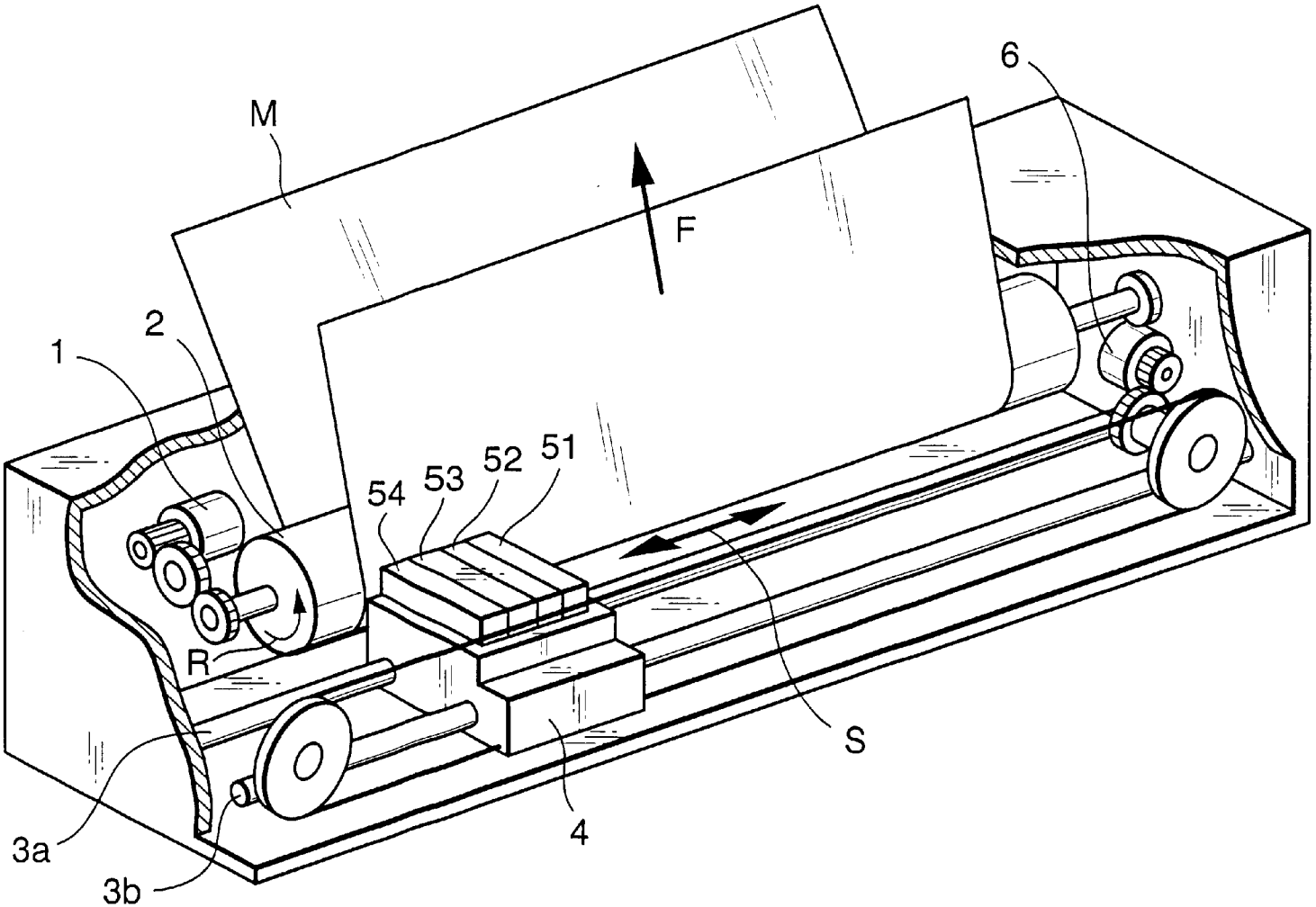
FIG. 3 is a perspective view schematically showing an ink-jet printer according to the second embodiment.

FIG. 3 is a perspective view schematically showing an ink-jet printer according to the second embodiment.

The same reference numerals as in FIG. 1A denote the same constituent components, and a detailed description thereof will be omitted.

Figure 4:
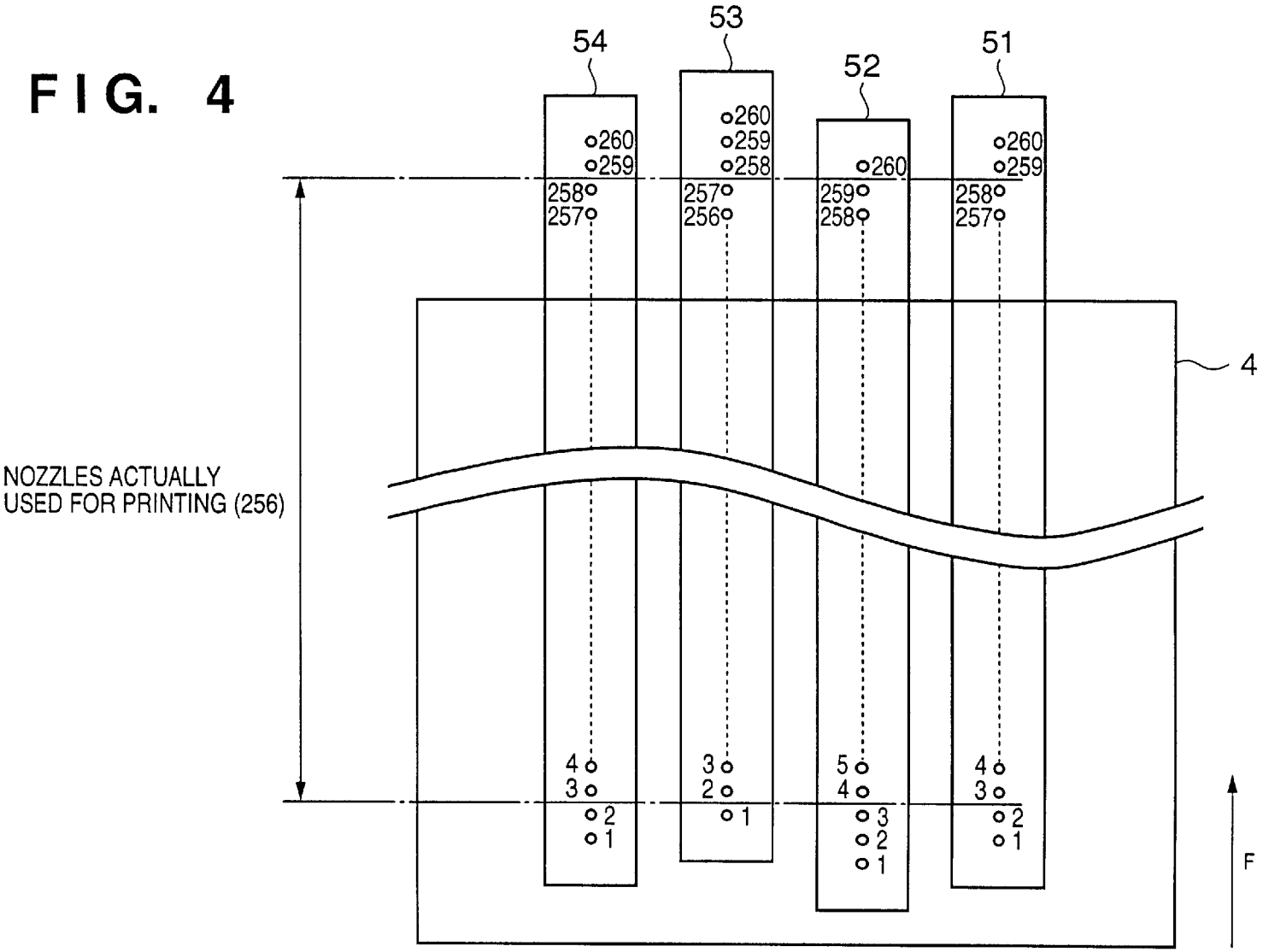
FIG. 4 shows an arrangement of nozzles of an ink-jet head according to the second embodiment.

Referring to FIG. 3, reference numerals 51 to 54 denote ink-jet heads. Each of the ink-jet heads 51 to 54 has 260 nozzles comprising printing elements that are arrayed such that their interval in the subscanning direction (a direction of an arrow F in FIG. 3) corresponds to 600 dpi. Note that the number of nozzles that are actually used for printing is 256 as shown in FIG. 4. Other nozzles are provided so a mechanical shift (in the subscanning direction), produced when loading the ink-jet heads 51 to 54 on a carriage 4, is corrected by selecting the nozzles for printing.

Note that inside each nozzle is a heating element for discharging ink.

The ink-jet head 51 is an ink-jet head that performs printing with the lowest-concentration ink (to be referred to as a light ink hereinafter) of the three different black-based inks with different-dye concentrations. The ink-jet heads 53 and 54 are ink-jet heads that perform printing with the highest-concentration ink (to be referred to as a dense ink hereinafter). The ink-jet head 52 is an ink-jet head that performs printing with the medium-density ink (to be referred to as a medium ink hereinafter).

The ink-jet printer according to the second embodiment also has a resolution of 600 dpi (main scanning direction)× 600 dpi (subscanning direction), in the same manner as the resolution of the ink-jet printer according to the first embodiment. The diameter of a dot formed by an ink droplet of each ink is about 65 $\mu$m on a light-transmitting film in the second embodiment.

In a medical image, particularly in a medical image that is observed by using transmitted light, a high image density is required.

In general, as the concentration of the printing agent is increased, various inconveniences occur. For example, in an ink-jet printer, as the dye concentration of the ink is increased, an inconvenience occurs in ink discharge due to an increase in ink viscosity or the like.

Namely, to increase the image density by increasing the concentration of the printing agent is limited.

In the ink-jet printer according to the second embodiment, an arrangement and control operation for obtaining a high image density are obtained and performed by setting the maximum multiple printing count of dense ink to 2, that is, by printing dense ink dots two times in an overlaying manner at substantially one position on a medium M.

Meanwhile, the maximum multiple printing count of medium and light inks used for improving the gray level is set to 1 by considering an ink overflow and the like.

Figure 5A:
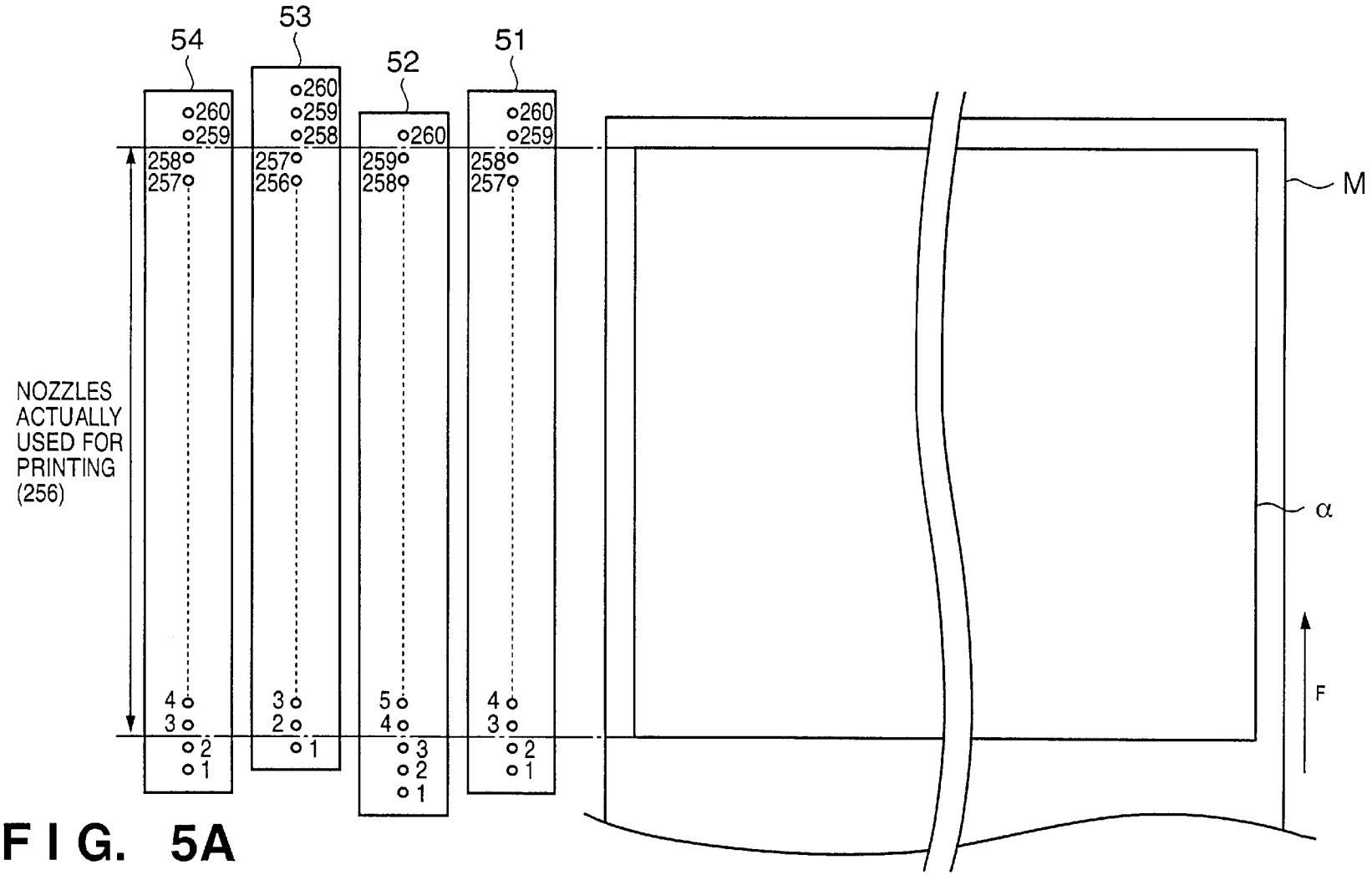
FIGS. 5A and 5B are views for explaining an image printing sequence in the ink-jet printer according to the second embodiment.
Figure 5B:
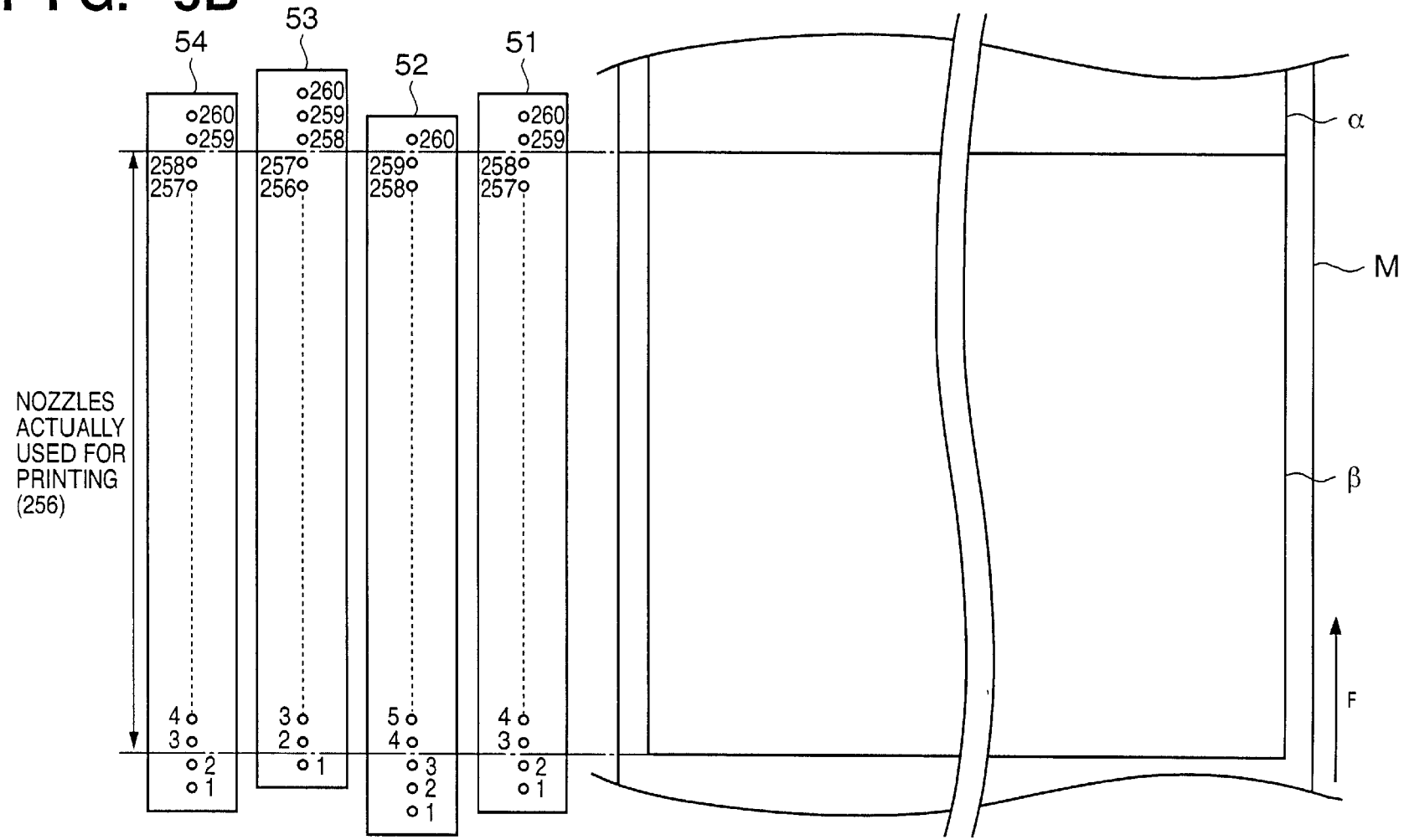

An image printing sequence for the ink-jet printer according to the second embodiment will be briefly described with reference to FIGS. 3, 5A and 5B.

When the medium M is conveyed to a predetermined image printing start position by rotation of the platen roller 2 or the like and is stopped, of the forward and backward reciprocal scanning of the carriage 4, forward scanning is performed. In this case, ink dots are printed in the portion indicated by_on the medium M in FIG. 5A in accordance with the image signal by using the selected 256 nozzles of the ink-jet heads 51 to 54.

Because of the printing operation performed during this one forward scanning, dense ink dots formed by using the two ink-jet heads 53 and 54 can be printed twice in an overlaying manner for one pixel on the medium M, and light or medium ink dots formed by using one ink-jet head 51 or 52 can be printed only once for one pixel on the medium M.

Subsequently, the medium M is conveyed (sub scanned) for a distance corresponding to the printing width (more specifically, 256/600 inch≈10.8 mm) driven by a sub scanning motor 1.

After that, of the forward and backward reciprocal scanning of the carriage 4, backward scanning is performed. The selected 256 nozzles of the ink-jet heads 51 to 54 are used, in the same manner as in forward scanning, and ink dots are additionally printed in the portion indicated by _ on the medium M in FIG. 5B in accordance with the image signal.

The medium M is then subscanned for 10.8 mm again. The same operation as that described above is repeated until reaching the image printing end position, and image printing is ended. The medium M is then delivered by rotation of the platen roller 2 or the like.

As described above, according to the second embodiment, when the number of ink-jet heads that perform printing with the dense ink, with which the maximum multiple printing count is 2 in order to obtain a high image density, is set to 2, when the number of ink-jet heads that perform printing with the light and medium inks, with which the maximum multiple printing count is 1 by considering an ink overflow or the like, is set to 1, and when the image printing sequence is performed in the above manner, that is, when the control and configuration are implemented such that the maximum multiple printing count ratio of the printing agents is equal to the ratio of the numbers of print heads (the print heads have the same number of printing elements used in actual printing) for performing printing with the respective printing agents, then image printing can be performed most efficiently. As a result, a decrease in printing speed due to the shortage of nozzles, and an increase in cost which occurs when some nozzle is not used at all or for a long period of time, can both be prevented.

The second embodiment exemplifies an ink-jet printer with a resolution of 600 dpi (main scanning direction)×600 dpi (subscanning direction), in the same manner as in the first embodiment. In an ink-jet printer in which the ink discharging timing of each ink-jet head is controlled and the position of an ink dot with a diameter of about 65 $\mu$m, which is printed on a light-transmitting film, is shifted so the resolution becomes 1,200 dpi (main scanning direction)× 600 dpi (subscanning direction), dots that are printed once to form two pixels adjacent in the main scanning direction are overlaid on each other sufficiently. Hence, the present invention is effective for this case as well.

Assume an ink-jet printer which has a known means for adjusting the mechanical position of each ink-jet head in the subscanning direction with respect to a carriage 4 and in which the position of the ink dot is shifted by adjusting the position of each ink-jet head in the subscanning direction, so the resolution becomes 1,200 dpi (main scanning direction)× 1,200 dpi (subscanning direction). In this ink-jet printer, dots that are printed once to form two adjacent pixels are also overlaid on each other sufficiently. Hence, the present invention is effective for this case as well.

Figure 6:
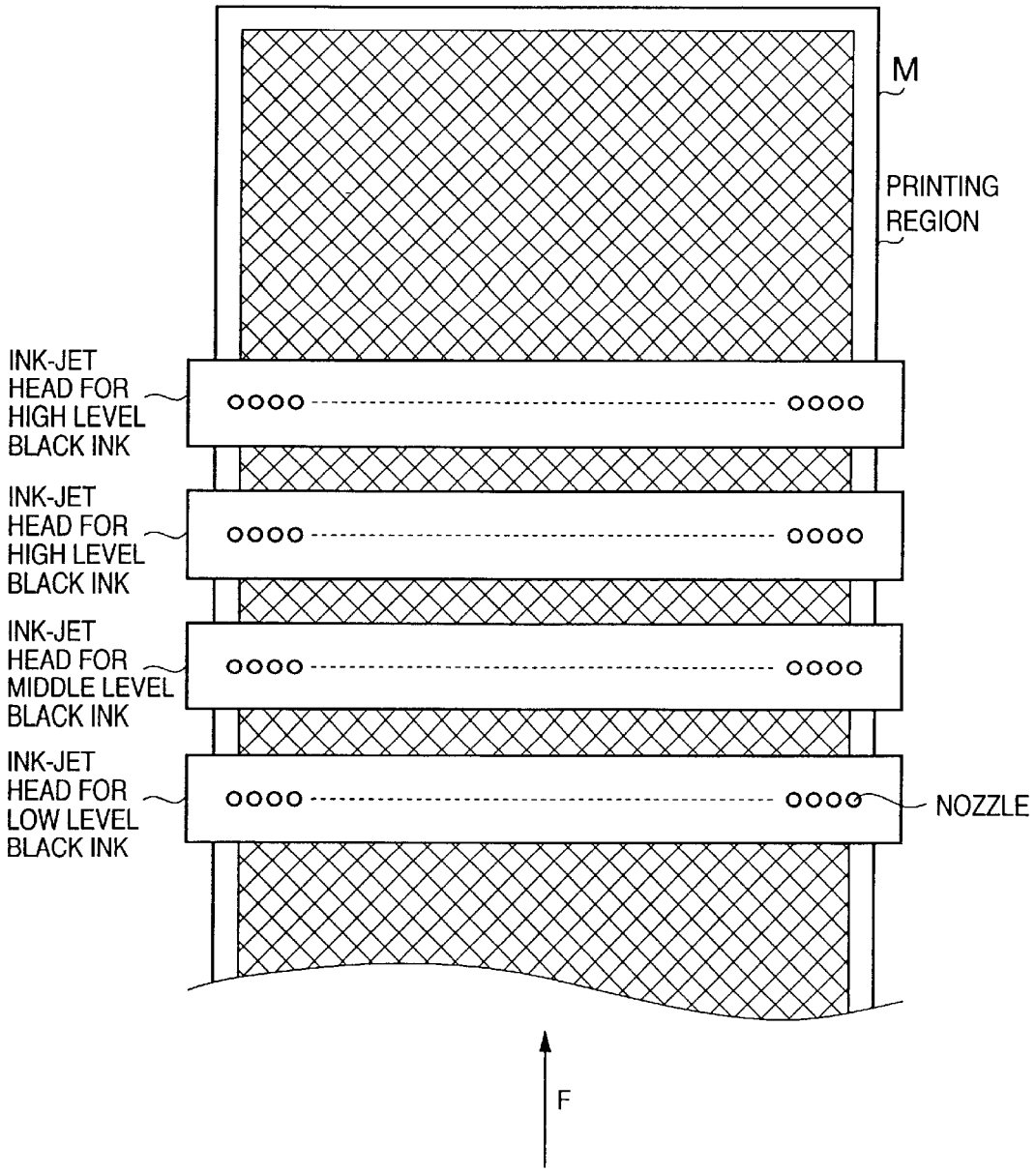
FIG. 6 is a view schematically showing an example of a full-multi-type ink-jet printer corresponding to the second embodiment.

In the first and second embodiments, the present invention is applied to a serial-scan-type ink-jet printer in which an ink-jet head mounted on a carriage is scanned reciprocally with respect to a medium which is being fed intermittently. The present invention is not limited to this ink-jet printer, but can also be effective for a so-called full-multi-type ink-jet printer, as schematically shown in FIG. 6, which is an example of an ink-jet head of the second embodiment, in which nozzles are arrayed in the widthwise direction of the medium entirely and only the medium is conveyed.

Although the maximum multiple printing count of each ink in the first and second embodiments is 1 or 2, it may be 3 or more.

In the first and second embodiments, the present invention is applied to an ink-jet printer. However, the present invention is not limited to an ink-jet printer, but can be applied to any printing apparatus so long as it performs printing with a plurality of types of printing agents on a printing medium by using a printing element.

In addition, the dot to be printed by a printing element need not have a circular shape or a shape close to it, but may have a shape close to a quadrangle.

The present invention may be applied to a system constituted by a plurality of devices (e.g., a host computer, an interface device, a reader, a printer, and the like) or an apparatus comprising a single device (e.g., a copying machine, a facsimile apparatus, or the like).

The object of the present invention is realized even by supplying a storage medium storing software program codes for realizing the functions of the above-described embodiments to a system or an apparatus, and causing the computer (or a CPU or an MPU) of the system or the apparatus to read out and execute the program codes stored in the storage medium.

In this case, the program codes read out from the storage medium realize the functions of the above-described embodiments by themselves, and the storage medium storing the program codes constitutes the present invention.

As a storage medium for supplying the program codes, a floppy disk, a hard disk, an optical disk, a magnetooptical disk, a CD-ROM, a CD-R, a magnetic tape, a nonvolatile memory card, a ROM, or the like can be used.

The functions of the above-described embodiments are realized not only when the readout program codes are executed by the computer but also when the OS (Operating System) running on the computer performs part or all of actual processing on the basis of the instructions of the program codes.

The functions of the above-described embodiments are also realized when the program codes read out from the storage medium are written in the memory of a function expansion board inserted into the computer or a function expansion unit connected to the computer, and the CPU of the function expansion board or function expansion unit performs part or all of actual processing on the basis of the instructions of the program codes.

As many apparently widely different embodiments of the present invention can be made without departing from the spirit and scope thereof, it is to be understood that the invention is not limited to the specific embodiments thereof except as defined in the appended claims.

What is claimed is:

1. A printing apparatus for performing printing with a plurality of types of printing agents on a printing medium by using a printing element, comprising:

printing elements for performing printing with each of the plurality of types of printing agents, said printing elements capable of printing ink droplets of the same type of printing agents in an overlaying manner at substantially one position on the printing medium, wherein the number of said printing elements for each of the plurality of types of printing agents is a number in accordance with a maximum multiple printing count of the ink droplets of each of the plurality of types of printing agents.

2. The apparatus according to claim 1, wherein a ratio of the maximum multiple printing count of the printing agents and a ratio of the number of recording elements that perform printing with the printing agents are substantially equal to each other.

3. The apparatus according to claim 1, wherein said printing elements for performing printing with the printing agents are exclusive printing elements used for performing printing with the printing agents.

4. The apparatus according to claim 1, wherein said printing element is a nozzle for discharging ink.

5. The apparatus according to claim 4, wherein an inner portion of said nozzle includes a heating element for discharging ink.

6. The apparatus according to claim 1, wherein the one position corresponds to one pixel.

7. A printing apparatus for performing printing with a plurality of types of printing agents on a printing medium by using one or a plurality of printheads with printing elements, comprising:

printheads for performing printing with each of the plurality of types of printing agents, said printheads capable of printing ink droplets of the same type of printing agents in an overlaying manner at substantially one position on the printing medium, wherein the number of said printheads for each of the plurality of types of printing agents is a number in accordance with a maximum multiple printing count of the ink droplets of each of the plurality of types of printing agents.

8. The apparatus according to claim 7, wherein said print heads for performing printing with the printing agents have printing elements in the same number.

9. The apparatus according to claim 8, wherein a ratio of the maximum multiple printing count of the printing agents and a ratio of the number of recording heads that perform printing with the printing agents are substantially equal to each other.

10. The apparatus according to claim 7, wherein said print heads for performing printing with the printing agents are exclusive printheads used for performing printing with the printing agents.

11. The apparatus according to claim 7, wherein the one position corresponds to one pixel.

12. A printing method of performing printing with a plurality of types of printing agents on a printing medium by using a printing element, wherein the printing can print ink droplets of the same type of printing agents in an overlaying manner at substantially one position on the printing medium, comprising:

a step of performing printing by using printing elements for each of the plurality of types of printing agents, of which a number of printing elements for each of the plurality of types of printing agents is a number in accordance with a maximum multiple printing count of the ink droplets of each of the plurality of types of printing agents.

13. The method according to claim 12, wherein a ratio of the maximum multiple printing count of the printing agents and a ratio of the number of recording elements that perform printing with the printing agents are substantially equal to each other.

14. The method according to claim 12, wherein the printing elements for performing printing with the printing agents are exclusive printing elements used for performing printing with the printing agents.

15. The method according to claim 12, wherein the printing element is a nozzle for discharging ink.

16. The method according to claim 15, wherein an inner portion of the nozzle includes a heating element for discharging ink.

17. A printing method of performing printing with a plurality of types of printing agents on a printing medium by using one or a plurality of printheads with printing elements, wherein the printing can print ink droplets of the same type of printing agents in an overlaying manner at substantially one position on the printing medium, comprising:

a step of performing printing by using printing heads for each of the plurality of types of printing agents, of which a number of printheads for each of the plurality of types of printing agents is a number in accordance with a maximum multiple printing count of the ink droplets of each of the plurality of types of printing agents.

18. The method according to claim 17, wherein the print heads for performing printing with the printing agents have printing elements in the same number.

19. The method according to claim 18, wherein a ratio of the maximum multiple printing count of the printing agents and a ratio of the number of recording heads that perform printing with the printing agents are substantially equal to each other.

20. The method according to claim 17, wherein the print heads for performing printing with the printing agents are exclusive print heads used for performing printing with the printing agents.

* * * * *